US005283928A

United States Patent [19]

Linn et al.

[11] Patent Number: 5,283,928

[45] Date of Patent: Feb. 8, 1994

[54] UNIVERSAL PAINT GRID

[75] Inventors: Richard A. Linn, Minneapolis; Wade H. Krinke, Marine on St. Croix, both of Minn.

[73] Assignee: Padco, Inc., Minneapolis, Minn.

[21] Appl. No.: 971,199

[22] Filed: Nov. 4, 1992

[51] Int. Cl.[5] ..... B44D 3/12

[52] U.S. Cl. ..... 15/257.06; 15/257.05

[58] Field of Search ..... 15/257.05, 257.06, 230.11; 220/698, 570

[56] References Cited

U.S. PATENT DOCUMENTS

| | | | |
|---|---|---|---|
| 2,669,965 | 2/1954 | Coughlan | 118/264 |
| 2,705,334 | 4/1955 | Farrow | 15/121.2 |
| 2,723,410 | 11/1955 | Sprung et al. | 15/121.2 |
| 2,893,030 | 7/1959 | Averna | 15/257.06 |
| 2,988,767 | 6/1961 | Tretwold | 15/257.06 |
| 3,079,625 | 3/1963 | Rasmussen | 15/257.06 |
| 4,083,466 | 4/1978 | McManaway | 220/90 |
| 4,145,789 | 3/1979 | Morgan, Sr. | 15/257.06 |
| 4,200,949 | 5/1980 | Heniff, Jr. | 15/257.06 |
| 4,756,046 | 7/1988 | Surface et al. | 15/257.06 |
| 4,865,282 | 9/1989 | Yonkman et al. | 248/111 |

*Primary Examiner*—Edward L. Roberts
*Attorney, Agent, or Firm*—Jacobson & Johnson

[57] ABSTRACT

A universal paint grid for attachment to either the internal ledge of a container or the external ledge of a different container comprising a paint grid member having a porous plate for rolling a paint roller thereon to remove excess paint from the paint roller with the universal paint grid including a pair of internal lips located on the grid member for engaging an internal ledge of a first container to hold a paint grid therein and a flexible panel integrally connected to the grid member with the flexible panel having a pair of flexible ears each having an external lip for engaging an external ledge on a different container to hold the universal paint grid therein.

8 Claims, 4 Drawing Sheets

UNIVERSAL PAINT GRID

FIELD OF THE INVENTION

The present invention relates to universal paint grids for distributing paint on paint rollers and, more particularly, to a universal paint grid which can be used either with a paint container having an external cover ledge or an internal cover ledge.

BACKGROUND OF THE INVENTION

Today paint rollers are being used more and more to apply paint to surfaces. Oftentimes, small paint rollers are dunked directly into the cylindrical paint container. To roll off excess paint, a paint distribution plate or paint grid is inserted into the paint container.

Briefly, a paint grid comprises a porous plate which is held in the container so that the user can roll the paint roller on the paint grid to remove excess paint from the roller. One of the problems is that paint containers, and particularly gallon containers, have different shapes which preclude the paint grids from being used with all containers, that is, plastic containers typically have an external ledge, while metal containers usually have an internal ledge, and since the paint grid must be held in the paint container, a paint grid which is usable with a container having an internal ledge is not generally usable with a container having an external ledge.

The present invention provides a universal paint grid which is usable with paint containers having either internal or external ledges.

DESCRIPTION OF THE PRIOR ART

U.S. Pat. No. 4,145,789 shows a paint distribution plate for inserting into an open mouth paint bucket with an external ledge. The paint distribution plate includes opposed flanges 32 which have notches therein which fit over the edge of the paint bucket. To hold the distribution plate in the paint bucket, he provides a resilient, U-shaped insert along the interior of his notch. The patent contends that the distribution plate is locked in the paint bucket by the coaction of the side edges of the distribution plate and the arcuate side walls of the paint bucket in conjunction with the lower edge of the distribution plate and the bottom of the paint bucket. It appears that the tight-fitting relationship between the plate and the interior of the paint bucket is primarily used for holding the distribution plate within the paint container.

U.S. Pat. No. 2,669,965 shows a flexible woven material such as terrycloth which is immersed in the paint and then pulled up to allow the user to roll the paint roller over the terrycloth.

U.S. Pat. No. 4,083,466 shows a a paint container extension with a mesh-like grid having hooks which are fixed over the lip of the paint container extension.

U.S. Pat. No. 4,200,949 shows a paint container and a device for wiping excess paint off the paint roller by squeezing on opposite sides of the roller.

U.S. Pat. No. 2,723,410 shows an adjustable paint roller feeder which permits adjustment of the depth of the paint roller shield into the paint container.

U.S. Pat. No. 2,988,767 shows a paint bucket with side ribs to permit the user to roll excess paint off the paint roller.

U.S. Pat. No. 2,705,334 shows a plane for attaching to the top of the container to allow a person to roll excess paint off a paint roller.

U.S. Pat. No. 3,079,625 shows a paint roller-coating apparatus which uses opposing rollers to roll paint onto the paint applicator.

U.S. Pat. No. 4,756,046 shows a painting accessory grid for rolling off excess paint which fits between ribs molded directly into the paint bucket.

U.S. Pat. No. 4,865,282 shows a grid for hanging over the edge of the container with a pocket for holding a paint brush on the backside thereof.

French patent 66020 shows a hanging paint grid for use in a paint container.

French patent 110104 shows a grid with a handle thereon.

BRIEF SUMMARY OF THE INVENTION

A universal paint grid for attachment to either the internal ledge of a container or the external ledge of a different container with the universal paint grid having a paint grid member having a porous plate for rolling a paint roller thereon to remove excess paint from the paint roller with the universal paint grid including a pair of internal lips located on the grid member for engaging an internal ledge of a first container to hold a paint grid therein and a flexible panel integrally connected to the grid member with the flexible panel having a pair of flexible ears each having an external lip for engaging an external ledge on a different container to hold the universal paint grid therein.

DESCRIPTION OF THE PREFERRED EMBODIMENT

Figure 1:
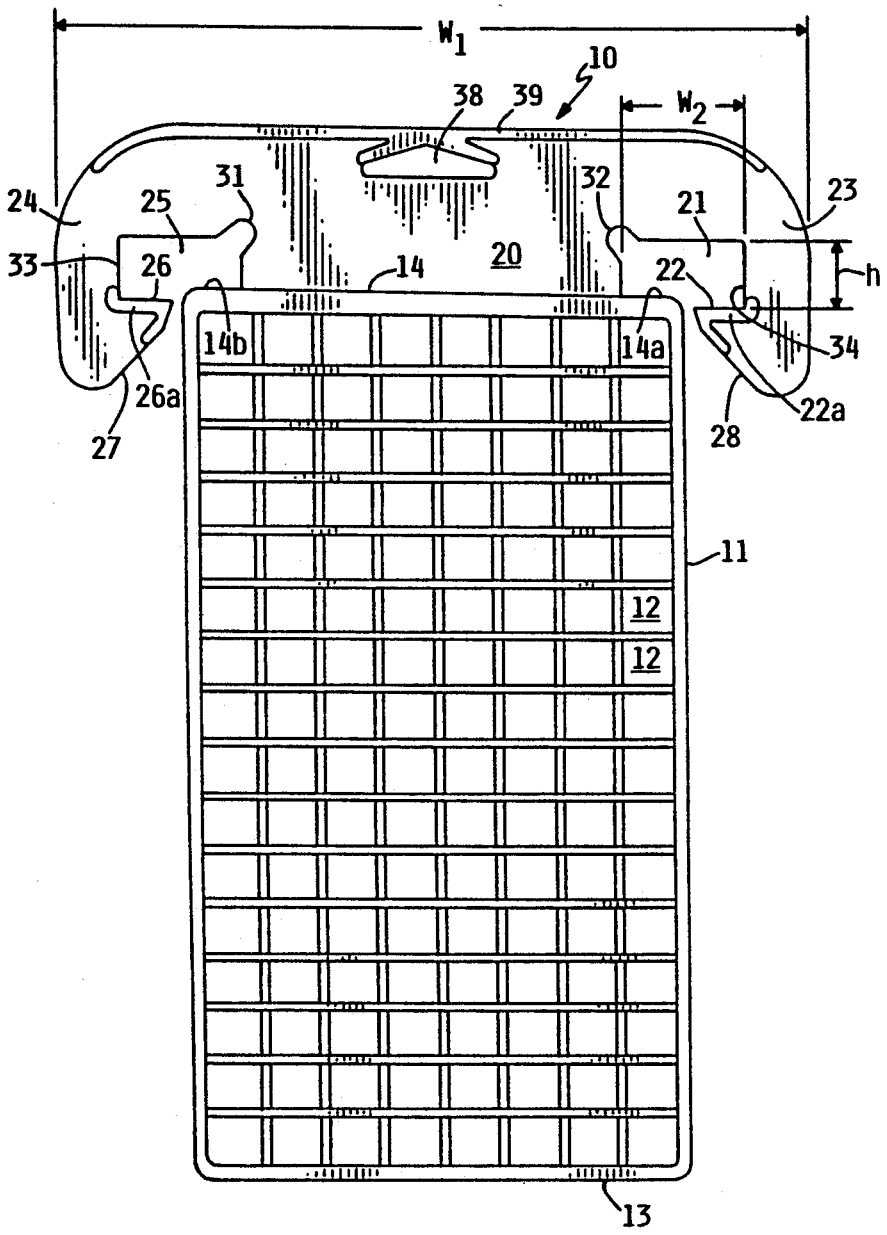
FIG. 1 is a front plane view of the universal paint grid of our invention.

FIG. 1 reference numeral 10 generally identifies the universal paint grid of the present invention. Paint grid 10 includes a grid member 11 comprised of a substantially planar member 11 having a plurality of regularly spaced rectangular openings 12 therein. Grid member 11 has a straight bottom edge 13 for engaging or placing on the bottom of a paint container, and a top edge edge 14 which is integrally connected to a flexible panel 20. Grid member 11 includes a first top lip **14*a* on one side of grid member 11 and a second top lip 14*b* on the opposite side of grid member 11. Connected centrally to edge 14 of grid member 11 is flexible panel 20** which includes a first hooked-shaped ear 23 having an internal lip 34 and a lower lip 22 having a reinforcing strip 22*a* thereon. Ear 23 forms a rectangular shaped opening 21 for encompassing either an internal or external annular ledge on a paint container. The outside of ear 23 forms a guide edge 28 for directing the ear over an external annular ledge on a paint container.

Similarly, located on the opposite side of panel 20 is a second hook-shaped ear 24 having an internal lip 33 and a lower lip 26 having a reinforcing strip 26*a* thereon. Ear 24 similarly forms a rectangular shaped opening 25 for encompassing either an internal or external annular ledge on a paint container. Also, the outside of ear 24 forms a guide edge 27 for directing ear 24 over an external annular ledge of a paint container.

Located in flexible panel 20 is a first rim notch 31 and a second rim notch 32 which fit over the edge of a container to partially engage the top edge of the container.

The opening 21 has a height designated by h and a width designated by $w_2$. The height and width are selected so as to have the opening sufficiently large so that it encompasses the ledge and the top portion of a paint container with either an internal or an external ledge. When paint grid 20 is not in use, the universal paint grid may be hung by placing opening 38 on a nail or the like. A reinforcing member 39 extends around the top portion for reinforcing the top portion of flexible panel 20. The width of the panel is designated by $w_1$. Panel 20 projects out beyond grid member 11 which is sufficiently narrow to fit into a paint container.

Figure 2:
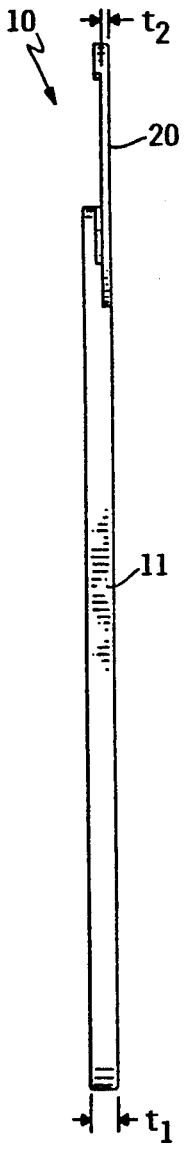
FIG. 2 is a side view of the universal paint grid of our invention.

FIG. 2 shows a side view of paint grid member 11 indicating grid member 11 has a thickness $t_1$, and flexible panel 20 has a thickness $t_2$ which is substantially less than the thickness of $t_1$ of grid member 11.

One of the features of the present invention is that grid member 11 is made from a flexible but resilient material such as polypropylene; however, grid member 11 is made substantially thick so as to have a certain amount of stiffness and rigidity so that it provides sufficient support so that one can roll a paint roller over grid member 11 to remove excess paint from the roller. In contrast, flexible panel 20, while made of the same material, is thinner than grid member 11 so as to have sufficient flexibility to permit engaging of ears 23 and 24 to the top portion of a paint container.

Figure 3:
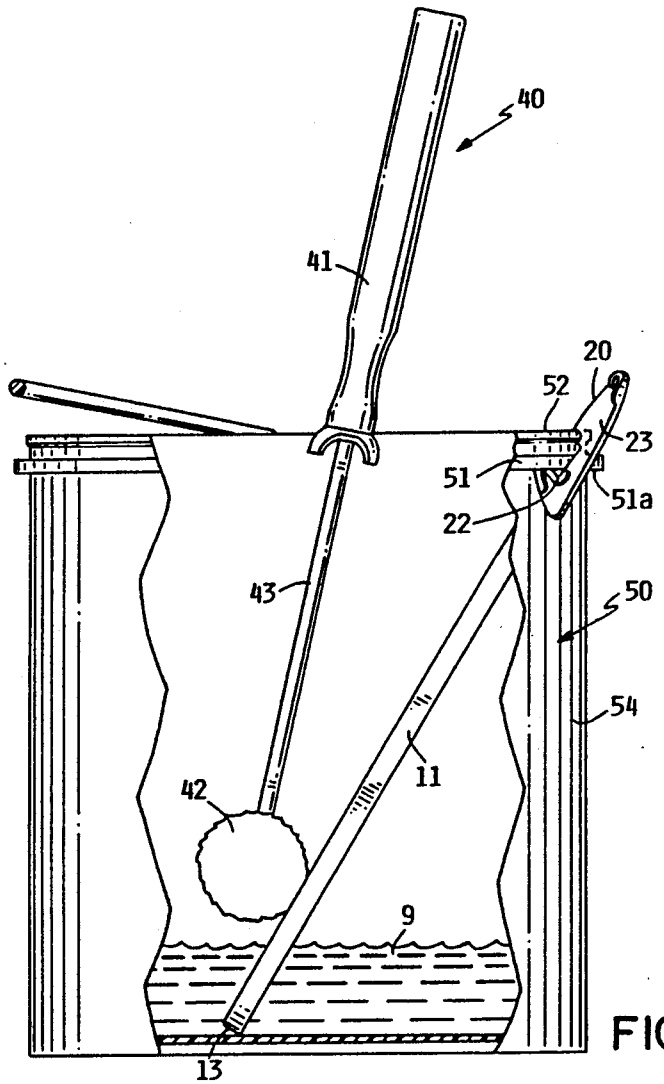
FIG. 3 is a partial, cutaway side view showing the universal paint grid located in a paint container with an external annular edge.

FIG. 3 shows a cross-sectional view which illustrates universal paint grid 10 mounted on the external ledge of a plastic paint container. Reference numeral 50 identifies a paint container which may be a gallon plastic bucket on the like. Paint container 50 has an external cylindrical surface 54 with an external annular ledge 51 having an annular underside 51*a*. The annular top edge of container 50 is identified by reference numeral 52. To illustrate the use of universal paint grid 10 with a paint roller, a paint roller applicator 40 is shown positioned therein with paint roller applicator 40 having a handle 41, a paint roller frame 43 and a roller 42 for rolling on grid member 11, so that any excess paint can fall back into paint 9 located at the bottom of container 50.

FIG. 3 also illustrates that grid member 11 is sufficiently rigid so that it provides support to roll roller 42 thereon. As can be observed in FIG. 3, lip 22 of ear 23 hooks on the annular underside 51*a* of external annular ledge 51 to hold one side of paint grid 10 onto container 50.

Figure 4:
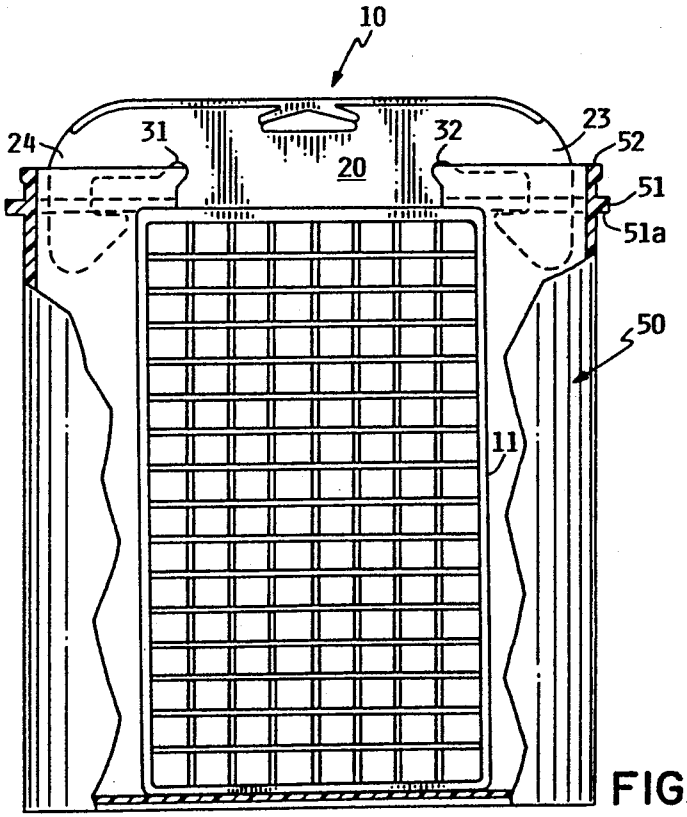
FIG. 4 is a partial, cutaway front view showing the universal paint grid located in a paint container with an external annular ledge.

FIG. 4 shows a front view of container 50 of FIG. 3 illustrating that the opposite ear 24, while shown in phantom, coacts with ear 23 to hold paint grid 10 onto annular lip 51. The recesses 31 and 32 are shown extending around top edge 52 of container 50. As can be envisioned from FIGS. 3 and 4, paint grid 10 is held at an acute angle with respect to the bottom through the use of ears 23 and 24 which engage lip 51 to hold the upper portion of paint grid 10 in position and by edge 13 which rests on the bottom of container 50.

Figure 5:
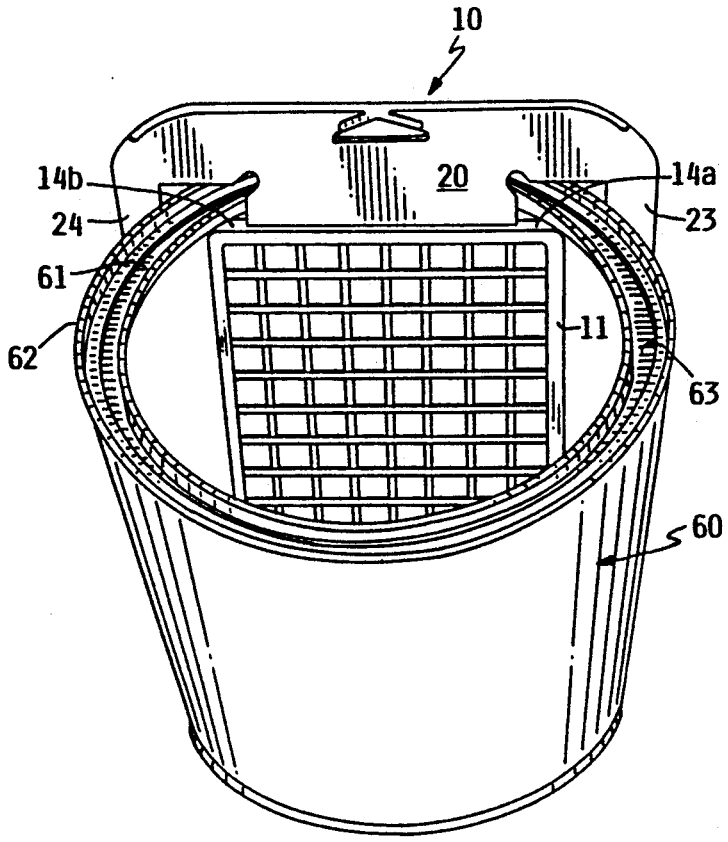
FIG. 5 shows a pictorial view of the universal paint grid located in a container with an inner annular ledge.

FIG. 5 shows the universal paint grid 10 in use with a metal paint container which has an internal annular ledge rather than an external annular ledge as shown in the paint container of FIGS. 3 and 4. Universal paint grid 10 lip 14*a* fits under internal annular ledge 61 and lip 14*b* also fits under internal annular ledge 61 to hold paint grid 20 in position in container 60. That is, the width of paint grid 10 is such that the lips 14*a* and 14*b* on the top edge of paint grid 10 coact with the underside of internal annular ledge 61. Since flexible panel 20 is more deformable than grid member 11, ears 22 and 27 can be flexed around the external annular ledge of the container to hold the grid in place.

Figure 6:
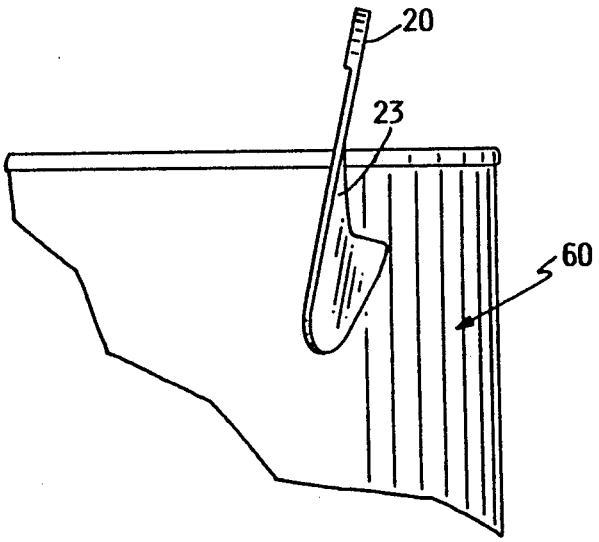
FIG. 6 shows a partial side view of the container and grid of FIG. 5.
Figure 9:
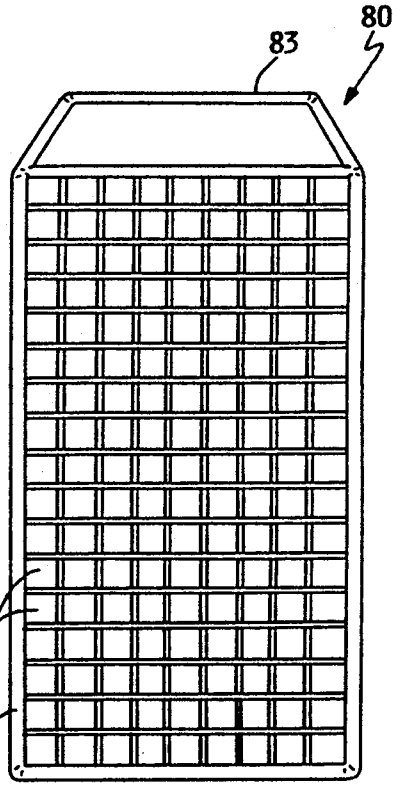
FIG. 9 (PRIOR ART)
FIG. 9 shows a prior art paint grid.

FIG. 6 illustrates how ear 23 can flex sufficiently to a nonplanar position to accommodate the positioning of grid member 11 when there is no external annular ledge.

Figure 7:
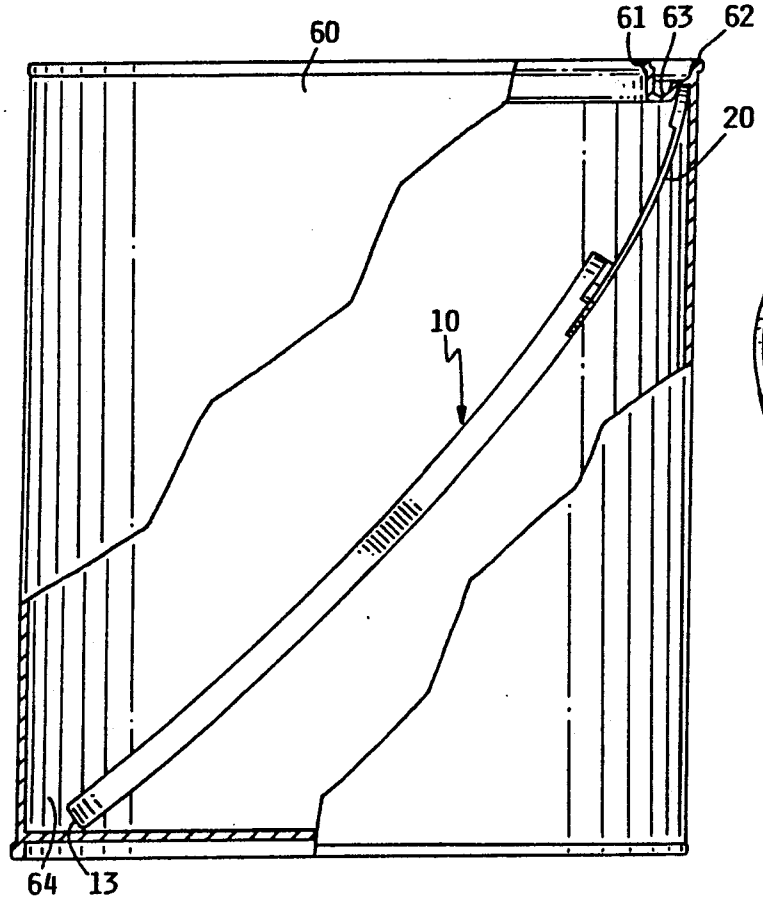
FIG. 7 shows an alternate method of mounting the universal paint grid in a container with an internal annular ledge.

FIG. 7 shows a further alternate use of the universal grid 10. In the embodiment, universal paint grid 10 has been flexed by placing flexible panel 20 and by folding ears 23 and 24 to fit inside container 60. The flexibility of panel 20 and ears 23 and 24 permits panel 20 to conform to the interior cylindrical shape of the container while still allowing the grid to maintain its substantially planar shape. This mounting is useful if a person wants to store the universal paint grid in the paint container between painting jobs.

Figure 8:
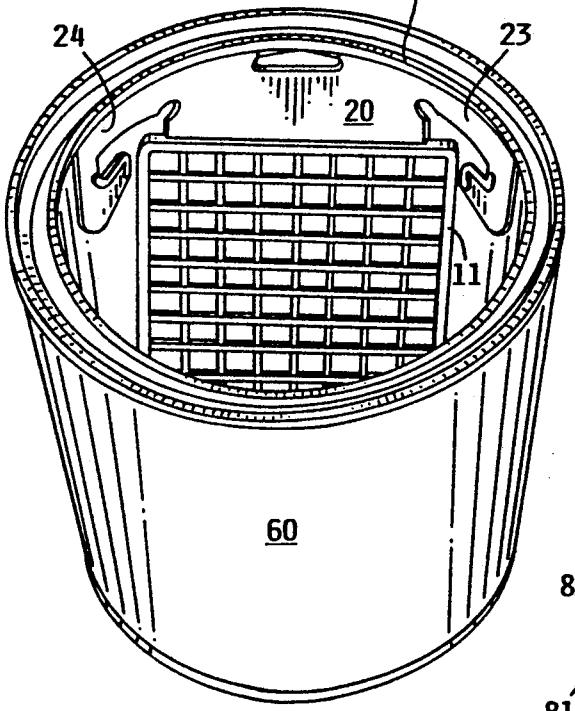
FIG. 8 shows a pictorial view of the universal paint grid and container of FIG. 7.

FIG. 7 illustrates the side view of grid 10 positioned with bottom edge 13 engaging the internal cylindrical surface 64 of container 60 with the top of panel 20 engaging the underside of internal annular ledge 61. Thus, it can be seen that paint grid 10 is held in position as shown in FIGS. 7 and 8 through the internal annular ledge on container 60. Thus, a feature of the invention is that the grid should have sufficient length so that when placed completely within the container, there is a small amount of flexing to hold grid member 11 in position under internal annular ledge 61.

FIG. 8 illustrates a prior art grid 80 having grid member 81 with rectangular shaped openings 82 therein and a handle 83 on the top, for engaging the underside of the lip of a container. The grid shown in FIG. 8 is not usable with the containers having external annular ledges since there is nothing for member 83 to abut against.

We claim:

1. A universal paint grid for attachment to either an internal ledge of a container or an external ledge of a different container comprising:

a grid member for rolling a paint roller thereon to remove excess paint from the paint roller;

a pair of lips located on said grid member for engaging an internal ledge of a first container to hold the grid member therein; and a panel integrally connected to said grid member, said panel having a pair of ears for engaging an underside of an external ledge on a different container to hold the grid member therein.

2. The universal paint grid of claim 1 wherein said grid member and said panel are made of polypropylene.

3. The universal paint grid of claim 1 wherein said grid member is rectangular in shape.

4. The universal paint grid of claim 1 wherein said ears include reinforcing members.

5. The universal paint grid of claim 4 including rim notches for engaging the top of a container.

6. The universal paint grid of claim 1 wherein said panel is made from a flexible and resilient material and said panel has a greater flexibility than said grid member.

7. A substantially planar universal paint grid for attachment to either the internal ledge of a container or the external ledge of a different container comprising:

a grid member, said grid member, having a surface for rolling a paint roller thereon to remove excess paint from the paint roller;

means located on said grid for engaging an internal top portion of a first container to hold the grid member in the first container; and resilient ears for engaging an external top portion on a different container to hold the universal paint grid therein to permit one to use the universal paint grid with either a container having an external ledge or an external ledge.

8. The universal paint grid of claim 7 wherein said resilient ears are sufficiently flexible to flex into a non-planar condition when said universal paint grid is located in a container having an internal ledge.

* * * * *